United States Patent [19]

Gebler et al.

[11] 4,034,794

[45] July 12, 1977

[54] CASTING PROCESS WITH LIGNOSULFONATE-HUMATE-GRAPHITE MOLD COATINGS

[75] Inventors: Kenneth A. Gebler, Munster, Ind.; John M. Ferrara, Palos Heights; Joseph V. Grothaus, South Holland, both of Ill.

[73] Assignee: Nalco Chemical Company, Oak Brook, Ill.

[21] Appl. No.: 763,468

[22] Filed: Jan. 28, 1977

Related U.S. Application Data

[63] Continuation-in-part of Ser. No. 627,645, Oct. 31, 1975, abandoned.

[51] Int. Cl.[2] ..... B22C 3/00

[52] U.S. Cl. ..... 164/72; 106/38.28; 427/133

[58] Field of Search ..... 164/72; 106/38.28; 427/133, 135

[56] References Cited

U.S. PATENT DOCUMENTS

| | | | |
|---|---|---|---|
| 3,445,251 | 5/1969 | Nevins | 106/38.3 |
| 3,474,852 | 10/1969 | Strauss et al. | 164/72 |
| 3,549,392 | 12/1970 | Strauss et al. | 106/38.23 |

*Primary Examiner*—Robert D. Baldwin

*Attorney, Agent, or Firm*—John G. Premo; Robert A. Miller; B. W. Sufrin

[57] ABSTRACT

A novel mold coating comprising humic acid, and/or humic acid salts, and graphite in a liquid suspension containing organic bonding agents is disclosed, as well as a method of forming ingots in which molten steel is poured into molds which are covered by the coating.

3 Claims, No Drawings

CASTING PROCESS WITH LIGNOSULFONATE-HUMATE-GRAPHITE MOLD COATINGS

This is a continuation-in-part of our copending application, Ser. No. 627,645 filed Oct. 31, 1975, now abandoned.

It has been the practice in the processing of molten metals to apply a coating to the surface of molds prior to pouring metal into the molds. This practice has been followed extensively in the steel industry, where ingot molds are normally coated prior to the forming of steel ingots. The recognized purpose of all of these coatings has been to improve the surface qualities of the molded metal. The function that most mold coatings are designed to perform is one of repelling splashes of molten metal and preventing them from solidifying on the mold walls.

The surface of solidified metal, which results from splashes adhering to the mold walls, normally oxidizes very rapidly. This surface oxidation plus high heat capacity acquired by adhering to the mold prevents the metal, which results from the splashes, from being incorporated into the main body of the ingot after the mold has been completely filled.

The failure of the metal from the splash to be incorporated into the main body of a metal ingot results in surface discontinuities, which must be removed from the ingot by burning, scarfing, grinding or other suitable means prior to fabrication of the ingot into shapes or sheets. If the discontinuities are not removed by one of these types of operations, they will result in defects in the finished metal products.

Various organic and inorganic materials have been tested in prior art endeavors to solve the problem of surface defects in metal, which are caused by splashes adhering to mold walls. Coal tar, graphite, asphalt and various combinations of these and similar materials have been most widely used. These materials have all been unsatisfactory in that the improvement in metal surface resulting from their use has been relatively slight in comparison to the expense and difficulty involved in applying them to molds.

The flammability of some of the prior art materials is undesirable from a safety point of view and all of the materials result in smoke and/or noxious fumes of one form or another. The materials containing a higher percentage of graphite are the least flammable and result in the lowest amount of smoke; however, they are extremely dirty and difficult to handle and apply to the mold walls.

One prior art material which has gained commmercial acceptance is a humic acid compound suspended in aqueous solution. This material is covered by U.S. Pat. No. 3,474,852 which is hereinafter incorporated by reference. While the use of materials such as humic acid for mold coating has gained commercial acceptance, it would be an advance in the art if a still better mold coating could be developed. The attributes of this mold coating would be that it would have to be easy to apply, allow ingots to cool uniformly, prevent surface discontinuities, by nonflammable, and be commercially practical.

Various inorganic materials have been tested for use as mold coatings with varying degrees of success, as to improvement of the surface qualities of the metal. None of these materials have been truly satisfactory or acceptable to the steel industry, due to non-metallic inclusions, which they have a tendency to introduce into the metal.

The mold coating of the subject invention comprises a humic acid compound exemplified by alkali metal salts of humic acid and alkaline earth metal salts of humic acid, in combination with graphite. Particularly for applications in which the coating is applied to molds at elevated temperature, it is essential that the coating contain an organic bonding agent; in addition to the humic acid, humic acid salt and graphite.

The alkali metal salts of humic acid which are useful in the subject invention are sodium humate, potassium humate and ammonium humate. For purposes of this invention the term "alkali metal salt" will be construed to include ammonium salts.

The alkaline earth metal salts of humic acid which are particularly useful in the subject invention are calcium humate and magnesium humate.

The humate salts which are useful in the subject invention are products of the reaction of humic acid with alkali metal or alkaline earth metal hydroxides or ammonia. The humic acids are a generic group of acids which are derived from humus, which is most often concentrated in top layer of soil and contains the organic decomposition products of vegetation and other organisms. Sources of humic acid are brown coal, lignite and the like.

One of the preferred sources of humic acid for use in the subject invention is leonardite, which is often found in association with lignite. Leonardite is primarily mined in Bowman County, N.D., Divide County, N.D., and in and around Alpine, Tex. Spectral analysis has indicated that leonardite is generically a mixture of humic acid and salts thereof. Leonardite is considered to be made up of a large condensed ring polymeric molecule containing carboxyl groups; however, the exact nature of the molecule has not been proven conclusively.

A typical leonardite sample, which is comprised of calcium, sodium, magnesium potassium, etc., salts of complex organic acid and free organic acid is partially analyzed as follows:

Ash . . . 14.01
C . . . 48.75–53.98
H . . . 3.75—4.70
N . . . 1.25
O . . . 31.99
$CH_3$ . . . 1.26
$CH_3O$ , . . 0.44
$CH_3CO$ . . . 0.38

The equivalent weight of the above sample of leonardite was determined to be 256.

In order to synthesize the humate salts of the invention it is only necessary to add an alkali metal or alkaline earth metal hydroxide or ammonia to the humic acid. The salt-forming reaction is preferably carried out in the presence of water. A more preferred humate salt is sodium humate and most preferably sodium leonardite.

The graphite selected for use in our invention may be in any of the commercially available forms, including both an amorphous and crystalline materials. It is only important that the material be capable of being suspended in aqueous solutions and thus the particle size should not be so large as to prevent this from occurring. We have found it particularly expedient and commerically advantageous to use amorphous graphite due to its lower cost and the absence of the need for extremely high purity material.

The particular organic bonding agent for use in the subject invention is not critical except that it must be one which is capable of adhering to a hot or cold metal surface when applied in spray or droplet form. Preferred organic bonding agents are lignosulfonic acid, alkali metal salts or lignosulfonic acid, alkaline earth metal salts of lignosulfonic acid, sugars and dextrins. In a particularly preferred embodiment of the subject invention, the organic bonding agent used is sodium lignosulfonate.

Other organic bonding agents which are useful in our invention include sugars having the general formula, ($C_nH_{2n}O_n$). These materials are classified generally as carbohydrates, monosaccharides, furanoside or pyranoside. A broad range of these materials have proven to be useful as organic binders in the mold coating of the subject invention. The most preferred of the sugars for use in the subject invention are monosaccharides. We have also found that a extremely useful material for use as an organic binding agent in the subject of our invention is molasses. This material is relatively inexpensive yets performs well when introduced into mold coating formulations.

The sugars employed as organic binding agents may also be fermented sugars or other such materials. Again, high purity is not necessary in this application.

Glycols are useful as aids to organic bonding as they raise the boiling point of the mixture when it is used in an aqueous slurry. The aqueous slurry then has less of a tendency to spatter when applied to a hot mold surface. The glycols are considered to be the group of diatomic alcohols of the aliphatic series. The most preferred material from this series for use in the subject invention is ethylene glycol. Ethylene glycol is also useful as a freezing point depressant for use when the mold coating is shipped or used as an aqueous mixture in cold weather.

Other materials which we have found useful in formulating the mold coating compositions of our invention include materials which will tend to regulate the viscosity of the aqueous suspension so that it may be evenly applied by spraying or brushing onto the mold surface. A particularly useful material in this regard is calcium sulfate. This material is inexpensive yet enables the formation of an even coating. While other alkaline earth or alkali sulfate salts will perform in our invention, we prefer to use calcium sulfate due to its relative cost and effectiveness. In addition, in the formulation of mold coating compositions according to our invention it is often times desirable to add a compound such as and alkali metal hydroxide exemplified by NaOH which will raise the pH of the aqueous solution to a high level so as to regulate the viscosity, and also to convert some of the humic and/or lignosulfonate to its corresponding alkali metal salt so as to insure solubility.

The still further optional ingredient in the mold coating compositions according to our invention are oxidizing agents, in particular sodium formate, which will tend to oxidize the surface of a mold when the coating is applied thus assuring adherence of the coating. Also, a biocide such as chlorinated hydrocarbon exemplified by pentachlorophenol may be added to prevent microbio attack on the mold coating composition during prolong storage.

The lignosulfonates which are useful in the subject invention are the ammonium, alkali metal and alkaline earth metal salts of lignosulfonic acid and lignosulfonic acids themselves. Methods of manufacture of lignosulfonic acid and various lignosulfonate salts are well known to the art. Suitable methods for the production of lignosulfonic acid and the isolation of various lignosulfonate salts are given by Friedrich Emil Brauns in the Chemistry of Lignin, published in 1952 by the Academic Press, Inc. of New York. A particular method for isolating lignosulfonic acid and manufacturing the various lignosulfonate salts is discussed on pages 111–125.

It is understood, however, that the practice of the subject invention is not limited to the use of lignosulfonates which are manufactured by any particular process.

All of the various ammonium, alkali metal and alkaline earth metal salts and the free acids are useful in the practice of the invention. The preferred lignosulfonates are the ammonium, sodium, and calcium lignosulfonates and combinations thereof.

Ingot molds are usually coated hot, at a temperature of from about 200° F to about 800° F. However, the coating of the subject invention can be used at temperatures ranging from room temperature to temperatures in excess of 1000° F. The most preferred temperature for coating when an aqueous slurry is used is approximately 300° F. This temperature is preferred, as it provides an efficient coating with a minimum of spattering, and violent steam emission with the attendant waste of material.

In the most preferred embodiment of the invention, the mixture is an aqueous slurry consisting of from about 10 to about 60% by weight of the mixture of the subject invention; and from about 40 to about 90% by weight of water. More preferable, the aqueous slurry contains from about 20 to about 50% by weight of the mixture of the invention, and from about 50 to about 80% by weight of water. In one particular preferred embodiment of the invention, the slurry contains about 80% water and about 20% by weight of the mixture of the invention.

Based on the dry weight of materials present in the subject invention, the humic or humic acid salt should be present in an amount equal to from about 7 to about 87% by weight of the dry mixture. More preferable, the humic acid or humic acid salt should be present in an amount of from about 20 to about 70% by weight. In a greatly preferred embodiment of the invention, the humic acid salt is sodium humate and is present in an amount equal to about 40% by weight of the dry mixture.

The graphite present in our invention is generally present in an amount to from about 7 to about 87% by weight of the dry mixture. More preferable, the graphite should be present in an amount of from 20 to about 70% by weight and in a still more preferable ratio about 40% by weight graphite present in the dry mixture. The alkali metal lignosulfonate is generally present at a level of from 3–70% by weight of the dry mixtures of the above two ingredients. A more preferred percentage is the lignosulfonate which is form 10–50% by weight of the dry material and a greatly preferred composition contains approximately 20% by weight of the dry material of lignosulfonate.

It is to be understood that the above percentages are based on the graphite, humic acid, or humic acid salt, and lignosulfonate alone and that the percentages will change accordingly when optional ingredients are added.

The mixture of the invention generally comprises in approximate percentages by weight 1–10% of a humic acid, an alkali metal salt of humic acid or an alkaline earth metal salt of humic acid; 1–10% of graphite; 0.5–5% of an alkali metal lignosulfonate; and 75–97% water. While the percentages are given as ranges, it will be seen that the ratio of ingredients may vary widely, and the addition of more or less of the compounds of our invention is contemplated so long as the material will still be fluid, although viscous. While it is often desirable to ship a concentrated material if possible due to the weight of water, oftentimes an end user will not have adequate equipment for diluting the concentrate, and hence it is generally preferred to ship material having the above approximate concentration.

In the use of this invention, which is generally employed in the formation of steel ingots or the like, an ingot mold is coated with the composition of this invention, steel is teemed into the ingot, and the steel is allowed to solidify or at least partially solidify, at which time the now formed steel ingot is removed from the mold. In the practice of this invention, the ingot molds generally warm or hot when coated and the composition of this invention will dry and adhere to the side of the mold. By the use of this coating when the steel is teemed into the mold, less erosion of the mold surface and better surface quality of the resultant ingot is obtained. As a further benefit, the ingot is often easier to remove from the mold eliminating costly "stickers" which contribute greatly to the cost of steel making operations in that they represent a tonage loss and ingots which must be replaced or refurbished before further use.

In coating molds with a mixture of the subject invention, the mixture may be blown or dusted on to the mold surface as a powder or applied to the surface as an aqueous dispersion by means of brushing, dipping, pouring, spraying, or other suitable means. Since the molds have substantial surface area vertical to the ground, it is important that the mold coating dispersion of our invention not run off; and hence, we prefer to prepare our mold coatings with a high viscosity. A preferred viscosity of our mold coatings dispersion falls within the range of 500–1500 cps as measured at room temperature. While both lower and higher viscosity materials will perform adequately in the subject of our invention, the viscosity range given above will enable a uniform coating to be applied to the mold walls and provide a simplified method for introducing an even coating.

Other useful adjuvants may be added to the mixture in minor quantities in an aqueous slurry. The addition of these adjuvants is made to enhance the properties of the slurry as to characteristics such as bacterial stability, freezing point, and viscosity.

A variety of bactericides has been used in quanitities of less than 1% by weight to enhance the stability of the mixture in an aqueous slurry. It is, of course, understood that the invention is not limited to the use of any particular bactericide or to any particular amount of bactericide. Any of a number of known agents can be used to inhibit bacterial growth in an aqueous system which is high in organic bonding agents such as sugars. A preferred class of biocides for use in this invention are chlorinated phenols which are added at from 0.001–0.5% by weight of the aqueous dispersion.

Other useful adjuvants that may be used in an aqueous slurry of the mixture of the subject invention are freezing point depressants, for use when the slurry is shipped or used in cold weather. The glycols are particularly useful as freezing point depressants for use in the subject invention, as pointed out above. A particularly preferred glycol is ethylene glycol.

In addition, a further optional ingredient which we have sometimes found beneficial to add in the course of our invention is a water soluble organic wetting agent. These materials may be cationic, ionic, or nonionic, the nonionic being preferred. Generally, these are common commercially available surfactant available from many of the chemical supply houses. A particular useful wetting agent for the practice of our invention is "Plurafac A-38" which is reported to be an oxyethylene straight chain alcohol available commercially from BASF Wynadotte Industrial Chemicals. It is to be understood, however, that we do not wish to be limited to this type of material but only to those which are generally water soluble, nonionic, and which will act as a wetting agent in combination with the other ingredients of our invention.

The invention will be better understood with reference to the following examples:

EXAMPLE I

A typical mold coating composition of the subject invention was made up as follows:

| Component | Weight Percent |
|---|---|
| Pentachlorophenol | 0.08 |
| Caustic soda (crystal) | 0.31 |
| Plurafac A-38 Flake (2) | 0.03 |
| Sodium Lignosulfonate (50% aqueous) | 4.45 |
| Sodium Humate (25% in water) | 16.30 |
| Sodium Formate (crystal) | 3.75 |
| Water | 64.52 |
| $CaSO_4 \cdot 2H_2O$ | 2.00 |
| Polytran FS (1) | 0.44 |
| Graphite | 4.54 |
| Molasses | 3.58 |

(1) A fermented sugar.
(2) A nonionic oxyethylated straight chain alcohol.

EXAMPLE II

A mold coating composition prepared without graphite similar to that in U.S. Pat. No. 3,474,852 was prepared.

| Component | Weight Percent |
|---|---|
| Pentachlorophenol | 0.10 |
| Caustic Soda (crystal) | 0.25 |
| Plurafac A-38 Flake (2) | 0.05 |
| Sodium Lignosulfonate (50% aqueous) | 5.50 |
| Sodium Humate (25% in water) | 20.10 |
| Sodium Formate (crystal) | 4.65 |
| Water | 69.35 |

The sodium humate which was used in the preparation of the above mold coatings was made by causticizing a crude leonardite mud. A small amount of crystalline caustic was added to the mold coating to provide an excess of sodium for reaction with any humic or lignosulfonic acid from the sodium humate or liqnosol and to produce a coating mixture at a pH of over 9.5. It was found that maintaining a pH above 9.5 was desirable for adherence to mold walls when the coating was applied in the form of a spray.

COMPARISON

A warm (250° F) mold was coated by brushing the composition of Example I on ½ (vertically) of the mold. The remaining ½ was coated with the composition of Example II.

Thirty pounds of No. 1020 steel at 2850° F was teemed into the mold. Upon cooling, the ingot was removed from the mold and examined. The surface protected by the material of Example I was smooth and scab-free. The surface protected by the composition of Example II was wrinkled from uneven cooling, and a number of scabs were evident indicating poor protection of the mold surface as compared to Example I.

It can be seen by the foregoing examples that the objects of the invention, to provide a mold coating which is easy to apply, adheres well to mold walls and results in a substantial improvement in the surface quality of metal, have been achieved. Since the mold coating, as typically made in the above example, is in the form of a stable slurry, it can be shipped as a bulk liquid; therefore, the additional object of the invention to provide a mold coating which is capable of being shipped and handled in a liquid phase has also been accomplished.

The improved surface characteristics on ingots formed by a process utilizing the mold coating of the subject invention, as shown in the above example, demonstrates that the object of providing an improved method of forming steel ingots has also been achieved.

Although the subject invention refers primarily to a mold coating and a method of forming steel ingots, an improved surface for contacting any molten metal can be achieved by coating the surface with a humic acid compound and graphite or a mixture of a humic acid compound and graphite with other useful adjuvants, as disclosed above. A specific example of a surface which can be improved by use of the coatings of the subject invention is the surface of sand or ceramic cores and molds for use in the casting of metals. Another example of a coated surface is the surface of graphite or ceramic crucibles for use in the melting or containing of molten metals.

We claim

1. In a method of forming steel ingots which comprises:
   a. Coating the mold surface of an ingot mold;
   b. Teeming molten steel into said mold;
   c. Allowing said steel to solidify;
   d. Removing said ingot from said mold;
   the improvement comprising coating the mold prior to pouring with an aqueous dispersion comprising in percentages by weight:
   A. 1.0–1.0.0% of a humic acid or its alkali metal or alkaline earth metal salts;
   B. 1.0–10.0% of graphite;
   C. 0.5–5.0% of an alkali metal lignosulfonate;
   D. 75–97% of water.

2. The method of claim 1 wherein the aqueous dispersion has a viscosity at room temperature of from 500–1500 cps.

3. The improvement of claim 1 wherein from 0.001–0.5% by weight of a chlorinated phenol is added as a biocide.

* * * * *

UNITED STATES PATENT AND TRADEMARK OFFICE

CERTIFICATE OF CORRECTION

PATENT NO. : 4,034,794

DATED : July 12, 1977

INVENTOR(S) : Kenneth A. Gebler, et al

It is certified that error appears in the above-identified patent and that said Letters Patent are hereby corrected as shown below:

"Line 21 of Claim 1."

A. [1.0-1.0.0%] of a humic acid or its alkali metal or alkaline earth metal salts;

"Letters Patent should read as:"

A. 1.0-10.0% of a humic acid or its alkali metal or alkaline earth metal salts;

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*